219-121 SR
7/14/81 XR 4,278,871

United States Patent [19] [11] 4,278,871
Schmidt-Kufeke et al. [45] Jul. 14, 1981

[54] ARRANGEMENT FOR EFFECTING THE SUPERFINE PERFORATION OF FILM-LIKE SHEETING WITH THE AID OF HIGH-VOLTAGE PULSES

[76] Inventors: Klaus-Peter Schmidt-Kufeke, Bernhardstr. 5, 7500 Karlsruhe 1; Gerhard Feld, Am Erlanger 3, 8501 Eckenthal, both of Fed. Rep. of Germany

[21] Appl. No.: 54,237

[22] Filed: Jul. 2, 1979

[30] Foreign Application Priority Data

Jul. 10, 1978 [DE] Fed. Rep. of Germany ..... 2830326

[51] Int. Cl.[3] ..... H05B 7/18

[52] U.S. Cl. ..... 219/384; 73/38; 493/364; 131/281; 131/336; 156/274; 219/121 EB; 219/383; 346/162

[58] Field of Search ..... 219/121 EB, 383, 384, 219/502, 509; 31/1; 73/38; 83/16, 170, 171, 360, 365; 93/1 R, 1 G; 99/358; 131/15 R, 15 B; 156/272, 274; 162/139, 192, 286; 264/154, 156, 25; 315/326; 346/74, 74 SB, 76, 150, 163

[56] References Cited

U.S. PATENT DOCUMENTS

| | | | |
|---|---|---|---|
| 2,141,869 | 12/1938 | Konig | 219/384 |
| 2,678,373 | 5/1954 | Suran | 219/384 |
| 3,017,486 | 1/1962 | Kogan et al. | 219/383 |
| 3,160,687 | 12/1964 | Andrews | 219/384 X |
| 3,183,518 | 5/1965 | Henry et al. | 346/76 |
| 3,351,740 | 11/1967 | Heuer | 219/384 |
| 3,385,951 | 5/1968 | Bancroft et al. | 219/384 |
| 3,419,752 | 12/1968 | Schmidt | 219/384 |
| 3,622,751 | 11/1971 | Larive | 219/384 |
| 3,783,237 | 1/1974 | McArthur | 219/384 |
| 3,985,997 | 10/1976 | Burley | 219/384 |

FOREIGN PATENT DOCUMENTS

| | | | |
|---|---|---|---|
| 1110509 | 1/1962 | Fed. Rep. of Germany | 219/383 |
| 2014000 | 10/1971 | Fed. Rep. of Germany | 219/384 |
| 2145048 | 3/1973 | Fed. Rep. of Germany | 219/384 |

*Primary Examiner*—Volodymyr Y. Mayewsky
*Attorney, Agent, or Firm*—Michael J. Striker

[57] ABSTRACT

Arrangement for effecting the superfine perforation of film-like sheeting with the aid of high-voltage pulses. The sheeting to be perforated is permitted to pass in a contactless manner between two areal electrode fields. The electrode fields consist of a multitude of needles which are aligned to one another in a mirror-inverted manner and arranged in rows, with each time pairs of them forming discharge or sparking gaps. The needles of the first electrode field are in a direct conductive connection with each time one high-ohmic resistor. Each needle pair is arranged within the secondary circuit of an ignition transformer. These transformers have a high transformation ratio. On the primary side, the transformers are connected via transistor switches, to a source of low d.c. voltage. The transistor switches are initiated groupwisely via a distributor (ring counter) which, in turn, is controlled by a clock-pulse generator.

10 Claims, 6 Drawing Figures

ARRANGEMENT FOR EFFECTING THE SUPERFINE PERFORATION OF FILM-LIKE SHEETING WITH THE AID OF HIGH-VOLTAGE PULSES

The present invention relates to an arrangement for effecting the superfine perforation of film-like sheeting with the aid of high-voltage pulses, consisting of a first electrode comprising a multitude of needles, and of a second electrode arranged at an equally spaced relation therefrom for serving as the counter (opposite) electrode, between which the continuous sheeting is permitted to pass and further consisting of a circuit arrangement with a transformer whose primary circuit, for the purpose of generating a short-lasting high-voltage pulse, is connected to a source of d.c. voltage, and in the secondary circuit of which there are lying both the first and the second electrode forming a sparking gap.

DESCRIPTION OF THE PRIOR ART

One arrangement of the type described hereinbefore has become known from the German Pat. No. 11 10 509. In this type which is in particular intended to produce tear-off perforations, the first electrode consisting of one row of needles, is opposed by a so-called line electrode. The sheeting to be perforated rests on this line electrode. All of the needles are arranged in parallel within the secondary circuit of a transformer and are simultaneously energized by a short-lasting high-voltage pulse.

A capacitor capable of being charged across a series resistor is arranged in series with a thyratron in the primary circuit of the transformer. The primary circuit is completed by initiating the thyratron. In the course of this, the capacitor is discharged across the primary winding and produces a high-voltage pulse on the side of the secondary winding, corresponding to the transformation ratio of the transformer. A discharge limiting resistor is arranged in the lead-in conductor extending to the needles.

This arrangement, however, is not suitable for effecting an exact superfine perforation because here there appears a completely uncontrollable distribution of the voltage potential in dependence upon the partial dielectric behaviour of the material to be perforated, at the puncture point. From this there result differently large perforation holes. In the case of a densely packed row of needles, it often happens that several adjacent discharges are performed through one and the same puncture point. This, however, leads to an enlargement of this one puncture point while the neighbouring points remain unperforated. Accordingly, perforation appears to be irregular as regards hole spacings and sizes of the puncture points. In addition thereto, the possible working cycle time of this circuit arrangement is relatively long.

In particular such film- or sheet-like materials are subjected to a superfine perforating process, which are so dense owing to their structures as to have originally either no breathing activity at all, or only a small one.

This is the case above all with plastics sheeting, artificial leather, coated textiles, or the like. For the most various applications, such as in the clothing inductry, such materials are required to have a certain water vapour permeability, by simultaneously requiring water tightness to a high degree. Water vapour permeability depends substantially on the number of perforations per surface unit, and their absolute size. Water tightness, however, is determined by the size of the three largest holes per 100 $cm^2$ surface area of the material. In order to meet the very high standard specification requirements in this respect, there must be achieved a regular and dense perforation by maintaining the smallest diameters of the perforation holes. These requirements are met by none of the hitherto conventional types of superfine perforating arrangements as disclosed, e.g. in the German Patent No. 20 14 000 and the German Offenlegungsschrift (DE-OS) P 21 45 048. Alone already an areal counter (opposite) electrode and the application of the sheeting to be perforated, to one of the electrodes causes the electric field which is being set up prior to the puncture, to have an excessive surface area. Therefore, the voltage required for the puncture, will have to be higher and the hole at the puncture point becomes correspondingly large.

Problem and Solution

It is the object of the invention, therefore, to provide an arrangement for effecting the superfine perforation of sheet-or film-like materials which, by requiring a small energy, guarantees a regular and dense perforation by maintaining the smallest hole diameters.

This object is achieved by the features set forth in claim 1. Advantageous embodiments of the subject matter of the invention are set forth in the subclaims.

Advantages

The advantages achievable by the invention reside above all in that smaller perforation holes result owing to a reduced burning time of the electrical discharge sparks. The production of ozone which, accordingly, is small compared with that of conventional arrangements, causes the process to become odourless so that the hitherto required exhaust systems may be dispensed with. Owing to the fact that the needle pairs are individually acted upon by a charge reduced to the actually required extent, also the noise level during the discharge process is reduced altogether to a tolerable extent. There is achieved a high water vapour permeability without exceeding the prescribed water permeability limits. By contactlessly guiding the sheeting in the vertical direction, damages are avoided in the case of film-or sheetlike materials having a sensitive surface, which are otherwise likely to be caused in cases where the material is caused to slide over a stationary electrode.

DESCRIPTION OF THE PREFERRED EMBODIMENT

Figure 1:
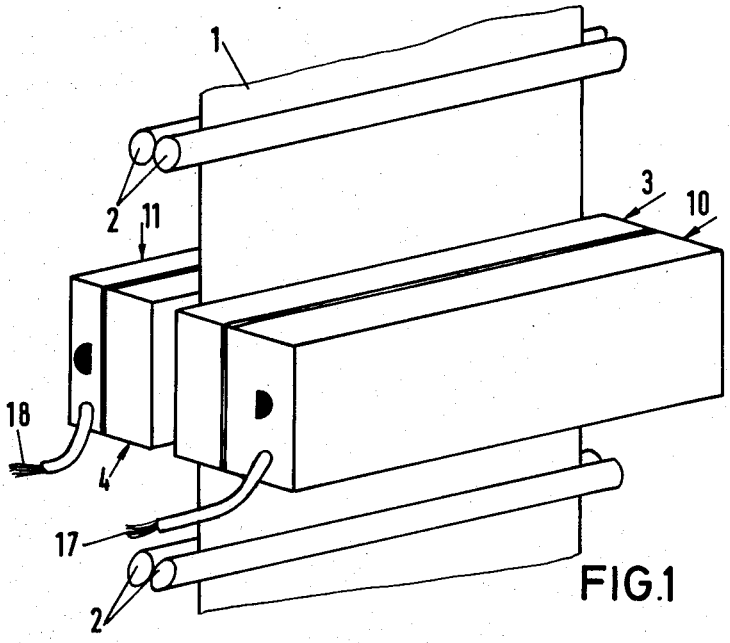
Figure 2:
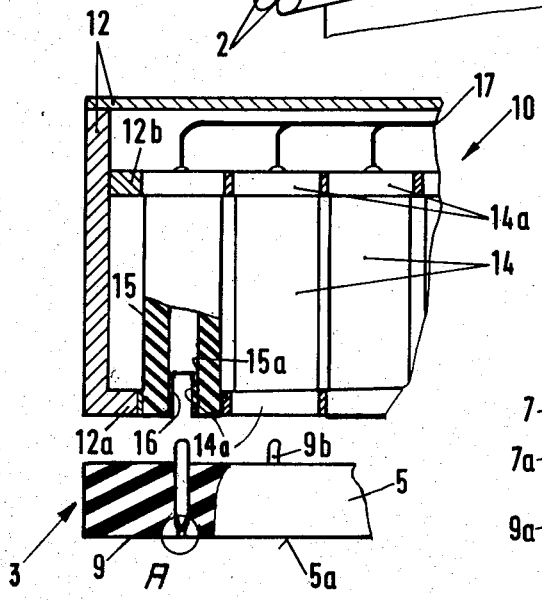
Figure 3:
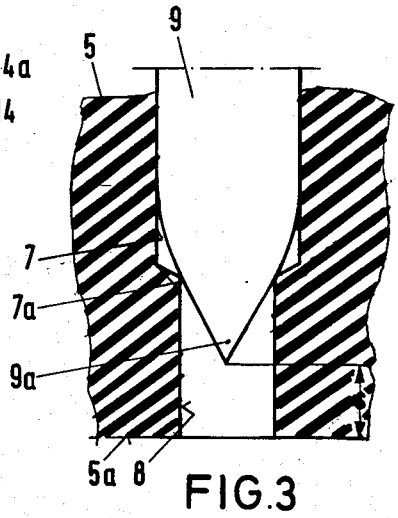
Figure 4:
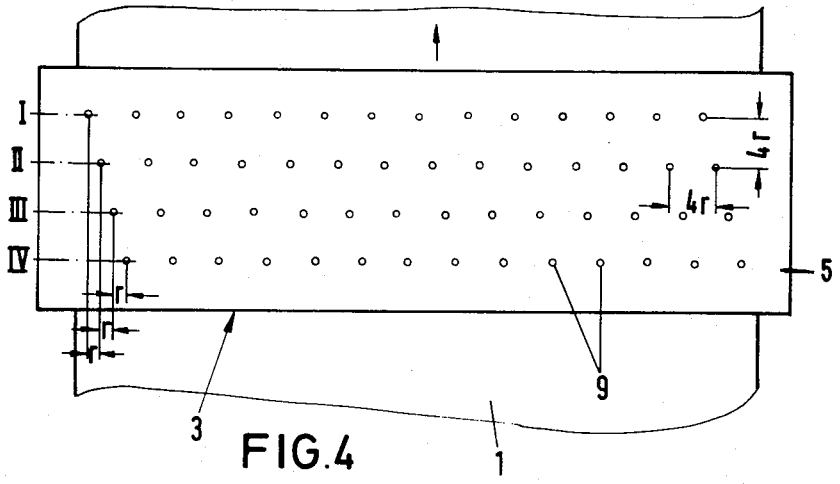
Figure 5:
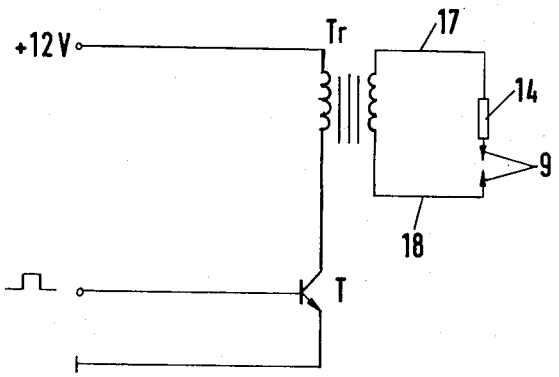

The invention will now be described in greater detail with reference to an example of embodiment shown in FIGS. 1 to 6 of the accompanying drawings, in which:

FIG. 1 shows the mechanical part of the arrangement according to the invention in a schematical perspective representation, FIG. 2 shows part of a needle field used as the first electrode in the arrangement according to FIG. 1, with its associated connecting board, partly in a sectional representation, FIG. 3 shows the detail A of FIG. 2 on an enlarged scale, FIG. 4 is the top view of a needle field according rear the invention, FIG. 5 shows one energizing circuit for one needle pair, as is used for operating the arrangement according to FIGS. 1 to 4, and FIG. 6 shows the block diagram of a circuit for controlling the arrangement as shown in FIGS. 1 to 5.

Figure 6:
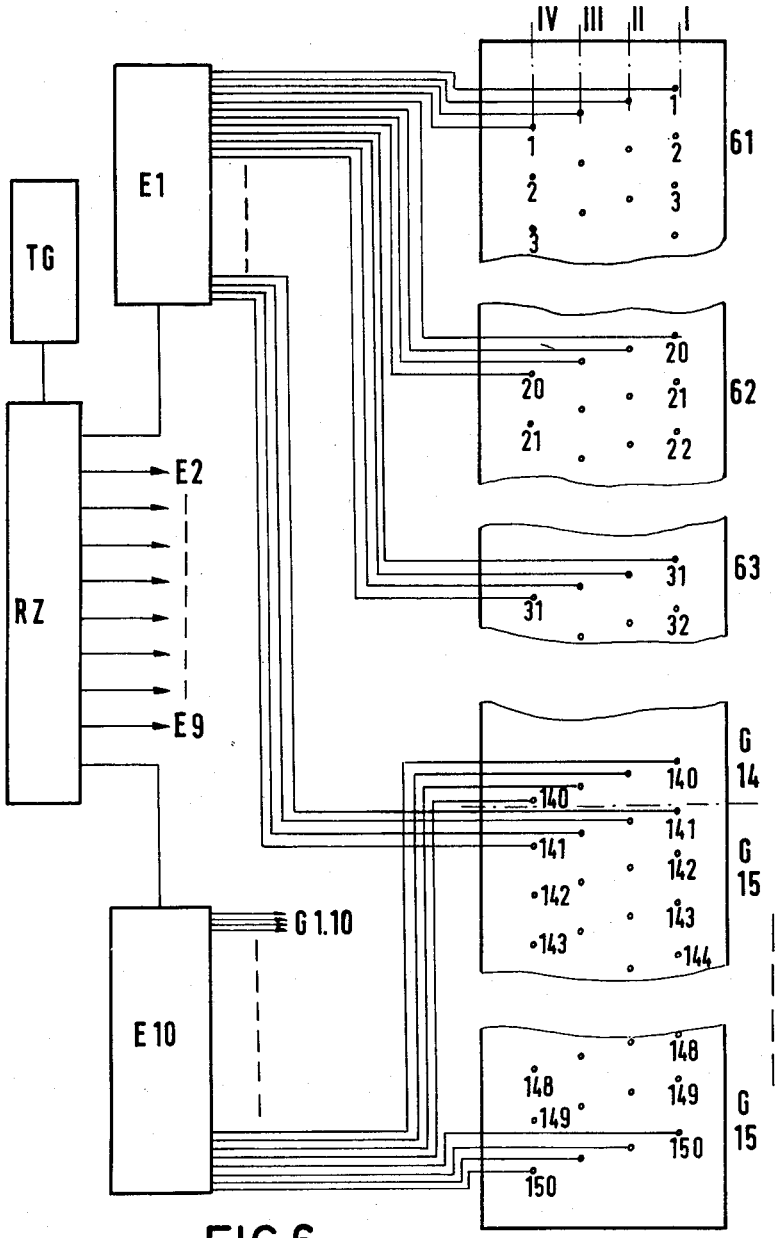

It is achieved by the arrangement as shown in FIGS. 1 to 4, in conjunction with the measures to be taken according to FIGS. 5 and 6 of the drawings, that the electron density tripping the disruptive discharge at the one electrode is reduced to a number of free electrons which is actually necessary for forming the charge cloud, and that by achieving a narrow lined electric field pattern, there is effected a focusing of the number of electrons tripping the disruptive discharge.

Focusing the electrons required for forming the charge could is carried out in a simple way by the direct spatial assignment of a high-ohmic resistor in series with that particular needle at which there is formed the charge carrier (ion) density. Focusing the electric field pattern is achieved in that needle-shaped electrodes are arranged opposite each other, with a minimum air gap existing on both sides between these electrodes and the sheeting to be perforated. This measure is based on the following physical recognition: If a dielectric having a substantially higher dielectric constant than air, completely fills the space between two points of a discharge gap, then the voltage required for effecting the disruptive discharge at otherwise equal parameters, is higher than in the case of an air gap provided for on both sides between the points and the dielectric. Owing to the fact that the dielectric constant of the dielectric is substantially higher with respect to air, the influence of the thus larger spacing between the two points is negligibly small. In distinction thereto, however, the electric field pattern density of the electric field produced by an equally high voltage, is greater on the surface of the dielectric.

The measures described hereinbefore are shown in FIGS. 1 to 4 to have been converted into a constructive solution. The schematical perspective representation of FIG. 1 which is not true to scale, shows the mechanical part of the arrangement. The shown embodiment is designed for enabling a vertical guidance of the sheeting 1 to be perforated. With the aid of each time one pair of web guide rollers 2 arranged above and below a first and a second electrode respectively, the sheeting 1 is passed at a predetermined rate of speed in an extensively contactless manner between the two electrodes. Owing to the vertical arrangement, the sheeting is prevented from coming to lie on one of the electrodes, so that surface damages to sensitive coatings of the sheeting, which are otherwise due to this, are reliably avoided. The two electrodes consist of multirow needle fields 3 and 4 extending over the entire width of the sheeting. FIG. 4 shows the needle field 3 in a rear view. The needle field 4 is designed in the same way, merely with the exception that in this case the needles 9 are arranged mirror-invertedly with respect to those of the needle field 3, and are in alignment with the needles 9 of the needle field 3. Both the needle fields 3 and 4 are stationarily arranged with their front sides facing one another, and at a spacing of somewhat more than the thickness of the sheeting. Each of the needle fields 3 and 4 is provided with a plug-in type connecting unit 10 and 11 respectively. With the aid of these units the needles 9 as arranged opposite each other in the needle fields 3 and 4, are connected in pairs, via separate control leads 17 and 18, to separate energizing circuits as shown in FIG. 5.

In their basis, the needle fields 3 and 4 consist of a board of insulating material 5 which, at a predetermined modular spacing (FIG. 4) is provided from the rear side with boreholes 7, as shown in FIG. 2. The diameters of the boreholes 7 are so dimensioned as to safeguard a firm seating of the needles 9 to be inserted therein later on. As is clearly shown in FIG. 3, showing the detail A of FIG. 2 on an enlarged scale, the respective borehole 7 proceeds into a borehole 8 having a smaller diameter. The thus resulting offset portion serves as a limit stop 7*a* for the needle 9. This limit stop is arranged in such a way that the point 9*a* of the needle 9 inserted until meeting against the limit stop, is set back by about half the needle diameter (spacing s) from the front side 5*a* of the board 5 of insulating material.

As can be recognized from FIG. 2, the needles 9 inserted until meeting against the limit stop, protrude with their pointless ends 9*b* from the rearward surface of the board 5 of insulating material. Jack sockets 16 provided for in the connecting units 10 and 11, correspond with these pointless needle ends. These units 10 and 11, as already mentioned hereinbefore, serve the pairwire connection of the needles 9 to the energizing circuits as shown in FIG. 5. The connecting unit 11 which is graphically not shown, is merely provided with jack sockets 16 which are each in an electrical connection with the control lead 18. The connecting unit 10, however, consists of a somewhat deeper casing 12 in which, in alignment to the pointless needle ends 9*b*, circular resistors 14 are supported in the bottom surface 12*a* and in a partition wall 12*b*. This type of resistor designed as film resistors having a hollow ceramic body 15, is provided with metallic connecting caps 14*a*. While the upper caps are each in connection with a control lead 17, the lower caps are provided with a jack socket 16 projecting into the hollow space 15*a* of the ceramic body 15. In this way there is established an optimum short and easy to detach connection between a needle 9 and its associated resistor 14.

FIG. 4 shows the rear view of the needle field 3 with a sheeting 1 moving past the front side thereof in the direction as indicated by the arrow. As is recognizable from the drawing, the needles 9 are arranged in four rows I to IV at equally spaced relations. The same spacing is also maintained between the needles within each row. These spacings, in accordance with the number of rows, are four times as large as the desired spacing r between the perforation holes. In addition thereto, the rows I to IV are laterally staggered by a spacing r corresponding to one perforation hole diameter. This staggered multirow arrangement of the needles 9 permits a groupwise sequence control of the needles 9 lying on the inclined lines of all rows. At a simultaneous continuous advancement of the sheeting 1, the perforation is gradually composed in the given hole pattern with a certain depth arrangement. As is still to be described in detail hereinafter, at a working cycle time of 1.5 ms and a rate of speed of advancement of the sheeting of 10 m/min., there will result a perforation hole raster having a spacing r of the perforation holes amounting to 2.5 mm in both directions. The spacing between the rows is variable by changing the speed at which the sheeting 1 is advanced.

As already mentioned hereinbefore, one energizing circuit according to FIG. 5 is provided for each of the needle pairs 9 opposing each other in the needle fields 3 and 4. This energizing circuit consists of an ignition transformer Tr which, with its primary winding is applied, via a switching transistor T, to a source of d.c. voltage. Both the needles 9 and the resistor 14 are connected via control leads 17 or 18 to the high-transformed secondary winding of the ignition transformer Tr respectively. This transformer is opened in response to an initiation of the transistor T. In the primary circuit of the transformer Tr there is flowing a current which, owing to the winding inductance, only reaches its final value after a certain period of time. The voltage induced in the secondary winding, in the course of this, is insufficient for effecting the ignition. Upon the end of the pulse-shaped initiation, the flowing current is suddenly interrupted. In consequence of this, there is caused a very high self-induction voltage causing the required high ignition voltage on the secondary side, which is responsible for effecting the disruptive discharge between the two needles 9 which, in cases where a film-like sheeting material is positioned between the needles 9, will produce with its puncture a microscopically small perforation hole therein.

In order to enable the sequence control described in conjunction with FIG. 4, there is provided a control circuit which is shown in a schematical block representation in FIG. 6. The circuit is designed for four-row needle fields ¾ each comprising 150 needles per row I to IV. These rows I to IV are subdivided into 15 groups G1 to G15 each having four×10 needles 9. The energizing circuits (FIG. 5) of the needle pairs which are alike in the sequence of counting, of all rows I to IV, are assembled to form control units E1 to E10. These units are connected to a ring counter RZ which, in turn, is stepped on by a clock pulse generator TG. At the aforementioned working cycle time of 1.5 ms the energizing circuits which are assembled to form the individual control units E1 to E10, are initiated one at a time in turn in a unitwise manner via the ring counter RZ, thus activating the associated discharge or sparking gaps in the way described hereinbefore.

What is claimed is:

1. An arrangement for electrically perforating a film-like sheet by means of high-voltage pulses, comprising an energizing circuit arrangement, a first stationary electrode including a first multi-row needle field member carrying a plurality of needles and a first connecting board to electrically connect said first needle field member to said energizing circuit arrangement; a second stationary electrode including a second multi-row needle field member carrying a plurality of needles and a second connecting board to electrically connect said second needle field member to said energizing circuit arrangement; said first multi-row needle field member being arranged at an equally spaced distance from said second multi-row needle field member to receive in a space therebetween said film-like sheet adapted for advancing movement along said members, said circuit arrangement including a transformer for generating the high-voltage pulses, said needles of said first needle field member being aligned in a mirror-inverted arrangement to said needles of said second needle field member and having point ends and pointless ends the latter of which directed toward said connecting boards respectively; and a series of high-ohmic resistors mounted in said first connecting board, said pointless ends of said needles being arranged in a direct conductive connection with said corresponding high-ohmic resistors, said first needle field member and said second needle field member each including a plate of insulating material having a plurality of openings for receiving said needles, and said distance between the spaced members being somewhat greater than the thickness of said film-like sheet.

2. The arrangement of claim 1, further comprising two pairs of guide rollers positioned opposite each other with a gap to receive said film-like sheet for advancing movement thereof.

3. The arrangement of claim 2, wherein said openings to receive said needles have a stepped diameter with a reduction formed in a direction toward said point ends of said needles, said reduction forming a limit stop for a needle mounted in said opening so that the point of the respective needle is inwardly spaced from the surface of said plate by a predetermined distance.

4. The arrangement of claim 3, wherein said pointless ends of said needles in each said plate are outwardly projecting from a rearward surface of said plate toward said corresponding connecting board.

5. The arrangement of claim 4, wherein said connecting boards are provided with jack sockets, said jack sockets being arranged against corresponding outwardly projecting pointless ends of said needles and adapted to plug on said pointless ends.

6. The arrangement of claim 5, wherein said high-ohmic resistors each includes a ceramic body terminating with a metallic cap at each end thereof, said metallic cap at one end of said body being electrically connected to said energizing circuit arrangement, said metallic cap at the second end of said body is formed with said jack socket.

7. The arrangement of claim 6, wherein said resistors in said connecting boards are identical in their technical values.

8. The arrangement of claim 7, wherein said energizing circuit arrangement further includes a number of ignition transformers having a high transformation ratio, each ignition transformer being at times connected to one pair of corresponding needles, said ignition transformers having primary circuits connected to a low d.c. voltage source, transistor switches to control said primary circuits, a clock-pulse generator and an electronic distributor to control said transistor switches.

9. The arrangement of claim 1, wherein said needles on said plate are positioned within the rows which are equally spaced in a longitudinal and in a transversal direction, said needle rows being staggered within the rows provided in the longitudinal direction.

10. The arrangement of claim 9, wherein needle pairs of said plurality of needles are electrically connected in groups and at times the needle pairs of one of said groups are simultaneously actuated upon generation of a high-voltage pulse.

* * * * *